US006950096B2

(12) United States Patent
Liao et al.

(10) Patent No.: US 6,950,096 B2
(45) Date of Patent: Sep. 27, 2005

(54) DRIVER FOR AMPLIFYING OPERATING VOLTAGE OF LUMINARY

(75) Inventors: Tai-Shan Liao, Taipei (TW); Min-Li Chen, Taipei (TW)

(73) Assignee: Precision Instrument Development Center National Science Council (TW)

( * ) Notice: Subject to any disclaimer, the term of this patent is extended or adjusted under 35 U.S.C. 154(b) by 358 days.

(21) Appl. No.: 10/223,138

(22) Filed: Aug. 19, 2002

(65) Prior Publication Data

US 2004/0046771 A1 Mar. 11, 2004

(51) Int. Cl.[7] ..... G09G 5/00

(52) U.S. Cl. ..... 345/204; 345/210; 345/211; 345/212

(58) Field of Search ..... 345/76–83, 90, 345/95, 204–214, 215

(56) References Cited

U.S. PATENT DOCUMENTS 3,893,165 A * 7/1975 Sunstein ..... 348/811
4,497,031 A * 1/1985 Froehling et al. ..... 700/276
5,769,527 A * 6/1998 Taylor et al. ..... 362/85
6,014,587 A * 1/2000 Shaw et al. ..... 607/45

* cited by examiner

*Primary Examiner*—Vijay Shankar
(74) *Attorney, Agent, or Firm*—Sutherland Asbill & Brennan LLP

(57) ABSTRACT

The present invention discloses a driver for amplifying an operating voltage of a low driving-voltage luminary. The driver includes a driving circuit providing a first signal, and a negative multiple voltage circuit electrically connected to the driving circuit and the luminary respectively for transforming the first signal into a second signal to be transmitted to the luminary, thereby the luminary being driven in response to the second signal. The luminary circuit is connected between power source (Vdd) and the negative multiple voltage circuit.

34 Claims, 6 Drawing Sheets

DRIVER FOR AMPLIFYING OPERATING VOLTAGE OF LUMINARY

FIELD OF THE INVENTION

The present invention is related to a driver for amplifying an operating voltage, and more particularly to a driver for amplifying an operating voltage of a low driving voltage and driving the luminary.

BACKGROUND OF THE INVENTION

Some luminaries including a light emitting display (LED), a laser diode and a liquid crystal display (LCD) are applied widely due to the properties of long life, low driving voltage, high reaction speed and shockproof, thus the development of the photoelectric industry is expedited vigorously.

Recently, several circuit devices of low driving-voltage luminaries have been disclosed, but all of them usually includes more transistors or are composed of complex integrated circuit devices. The inventor of the present invention disclosed a circuit device of a low driving-voltage luminary in 2001 and 2002. Shown in FIG. 1(*a*) and 1(*b*), the circuit device is composed of two transistor Q and Q', a resistor P, an inductor L and a capacitor and includes least elements without introducing any transformer. The circuit device of a low driving-voltage luminary drives the luminary via the lowest voltage about 1 V. However, some luminaries having protecting circuits are driven via an operating voltage about 4.5 V, so as to keep the electric device operating stably and protect luminaries. Therefore, the present invention is attempted to improve the prior art and provides a driver for amplifying an operating voltage of a low driving voltage, wherein the electric device can be operated stably and conform to being economic. Although the prior art discloses a driver for driving a low driving-voltage luminary, the driver of the prior art can't provide the luminary with a wide-ranged operating voltage or drive a luminary having a protecting circuit stably.

Hence, the present invention is attempted to improve the prior art and provides a driver for amplifying an operating voltage of a low driving voltage and driving the luminary.

SUMMARY OF THE INVENTION

It is one object of the present invention to provide a device for amplifying an operating voltage of a low driving voltage and driving the luminary.

According to the present invention, a driver for amplifying an operating voltage of a luminary includes a driving circuit providing a first signal, and a negative multiple voltage circuit electrically connected to the driving circuit and the luminary respectively for transforming the first signal into a second signal to be transmitted to the luminary, thereby the luminary being driven in response to the second signal.

Certainly, the first signal can be an alternating current signal.

Certainly, the second signal can be a direct current signal.

Certainly, the second signal can be a negative voltage.

Preferably, the second signal has an absolute voltage larger than that of the first signal.

Certainly, the operating voltage can be larger than 4.5 V.

Certainly, the luminary can be driven via a relatively low driving voltage.

Certainly, the relatively low driving voltage can be used less than 1.5 V.

Certainly, the driving circuit can be a step-up circuit via capacitor-inductor oscillating.

Certainly, the negative multiple voltage circuit further includes a first capacitor electrically connected to the driving circuit, a first diode having an anode electrically connected to the first capacitor and a cathode grounded, a second diode having an anode and a cathode electrically connected to the first capacitor and the anode of the first diode simultaneously, and a second capacitor having one terminal electrically connected to the anode of the second diode and the luminary simultaneously and another terminal grounded.

Preferably, the driver further includes a protecting circuit electrically connected between the anode of the second diode and the luminary.

According to the present invention, a driver for amplifying an operating voltage of a luminary and driving the luminary includes a driving circuit providing a first signal, and a rectifying circuit electrically connected to the driving circuit and the luminary respectively for transforming the first signal into a second signal to be transmitted to the luminary, thereby the luminary being driven in response to the second signal.

Certainly, the first signal can be an alternating current signal.

Certainly, the second signal can be a direct current signal.

Certainly, the second signal can be a negative voltage.

Preferably, the second signal has an absolute voltage larger than that of the first signal.

Certainly, the operating voltage can be larger than 4.5 V.

Certainly, the luminary can be driven via a relatively low driving voltage.

Certainly, the relatively low driving voltage can be used less than 1.5 V.

Certainly the driving circuit can be a step-up circuit via capacitor-inductor oscillating.

Preferably, the rectifying circuit further includes a diode having a cathode electrically connected to the driving circuit and an anode, and a capacitor having one terminal electrically connected to the anode of the diode and the luminary simultaneously and another terminal grounded.

Preferably, the driver further includes a protecting circuit electrically connected between the anode of the diode and the luminary.

According to the present invention, a driver for amplifying an operating voltage of a luminary and driving the luminary includes a driving circuit providing a first signal, and a step-up circuit electrically connected to the driving circuit and the luminary respectively for transforming the first signal into a second signal to be transmitted to the luminary, thereby the luminary being driven in response to the second signal.

Certainly, the first signal can be an alternating current signal.

Certainly, the second signal can be a direct current signal.

Certainly, the operating voltage can be larger than 4.5 V.

Certainly, the luminary can be driven via a relatively low driving voltage.

Certainly, the relatively low driving voltage can be used less than 1.5 V.

Certainly, the driving circuit can be a step-up circuit via capacitor-inductor oscillating.

Preferably, the step-up circuit further includes a first capacitor electrically connected to the driving circuit, a first diode having an anode electrically connected to the first capacitor and a cathode grounded, a second diode having an anode, and a cathode electrically connected to the first capacitor and the anode of the first diode simultaneously, and a second capacitor having one terminal electrically connected to the anode of the second diode and the luminary simultaneously and another terminal grounded.

Preferably, the driver further includes a protecting circuit electrically connected between the anode of the second diode and the luminary.

Certainly, the step-up circuit can be a negative multiple voltage circuit.

Preferably, the negative multiple voltage circuit further includes a first capacitor electrically connected to the driving circuit, a first diode having an anode electrically connected to the first capacitor and a cathode grounded, a second diode having an anode, and a cathode electrically connected to the first capacitor and the anode of the first diode simultaneously, and a second capacitor having one terminal electrically connected to the anode of the second diode and the luminary simultaneously and another terminal grounded.

Preferably, the driver further includes a protecting circuit electrically connected between the anode of the second diode and the luminary.

Certainly, the step-up circuit is a rectifying circuit

Preferably, the rectifying circuit further includes a diode having a cathode electrically connected to the driving circuit and an anode, a capacitor having one terminal electrically connected to the anode of the diode and the luminary simultaneously and another terminal grounded.

Preferably, the driver further includes a protecting circuit electrically connected between the anode of the diode and the luminary.

Now the foregoing and other features and advantages of the present invention will be more clearly understood through the following descriptions with reference to the drawings, wherein:

DETAILED DESCRIPTION OF THE PREFERRED EMBODIMENT

Figure 1A:
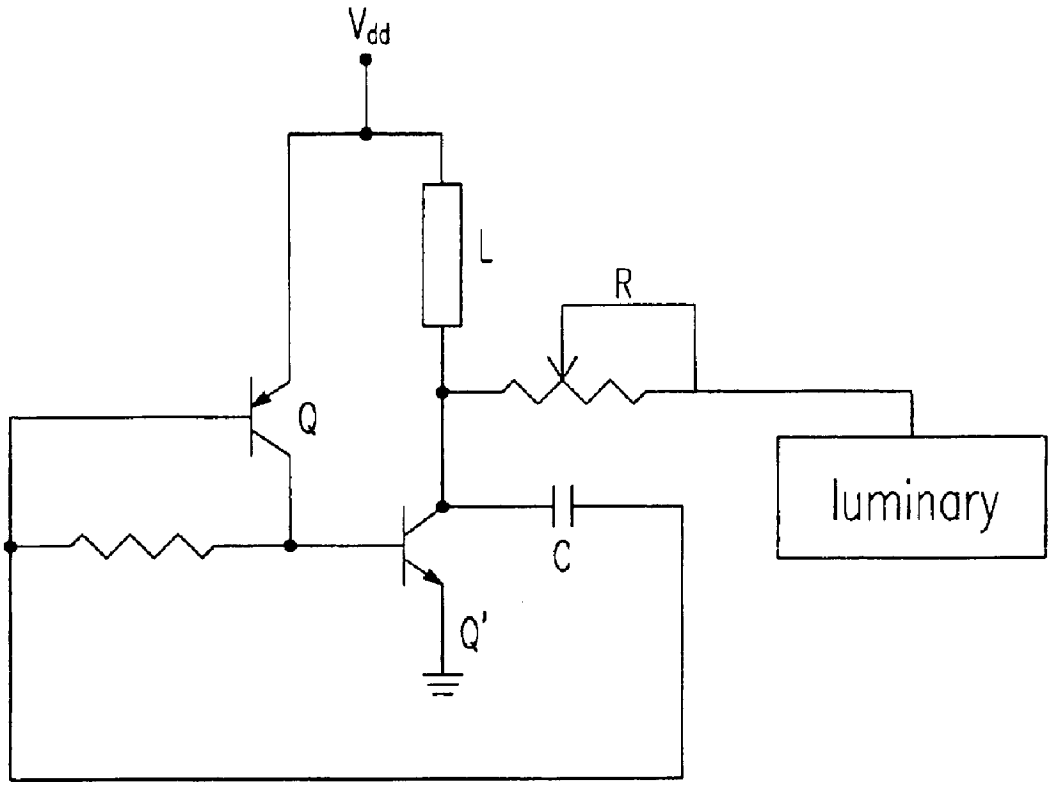
Fig. 1(a) (PRIOR ART)
FIGS. 1(*a*)–1(*b*) illustrate a driver of the prior art for driving a low driving-voltage luminary.
Figure 1B:
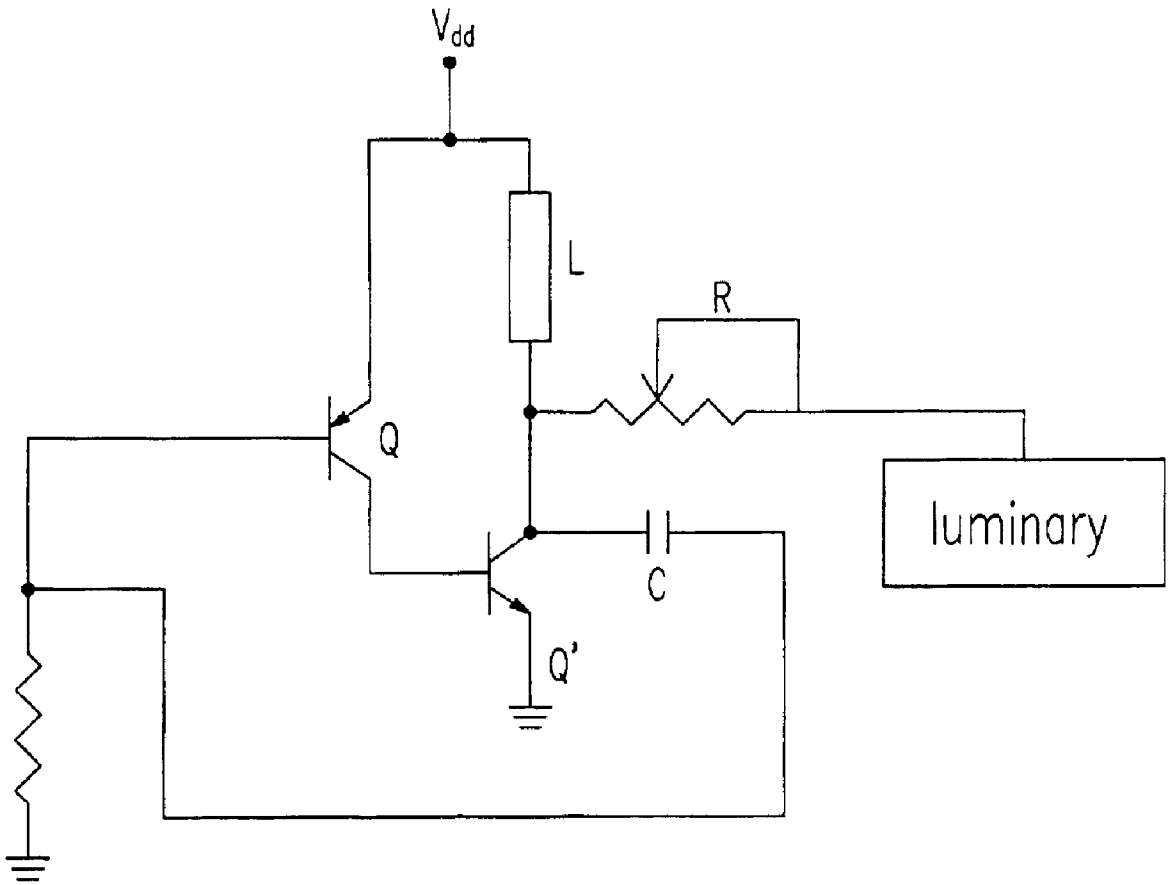
Fig. 1(b) (PRIOR ART)
Figure 2:
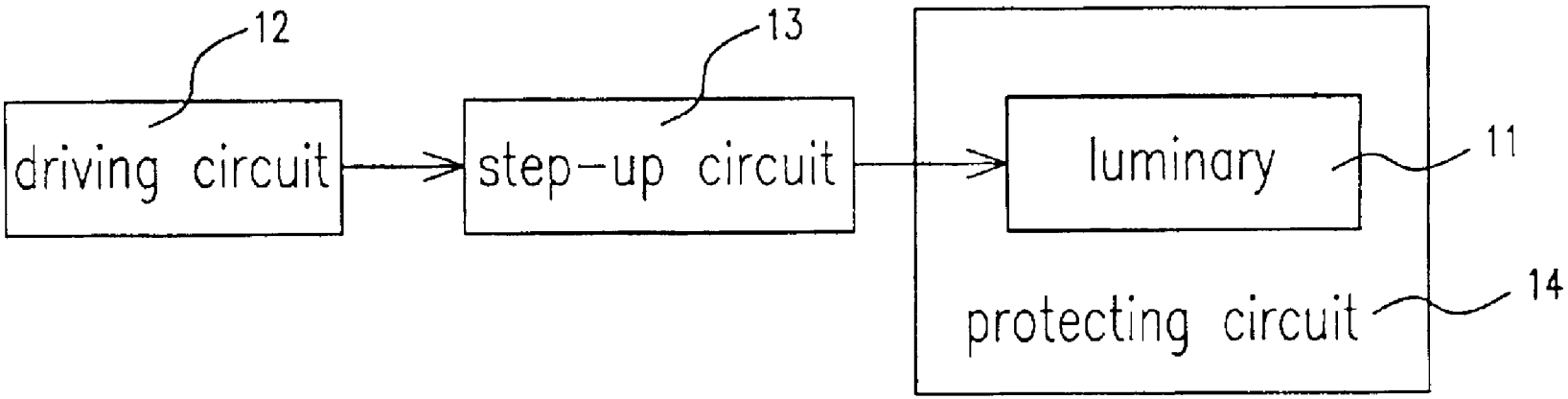
FIG. 2 illustrates a functional diagram of the present invention.

Please referring to FIG. 2, it illustrates a functional diagram of the present invention. The driver for amplifying an operating voltage of a luminary 11 includes a driving circuit 12, and a step-up circuit 13 electrically connected to the driving circuit 12 and the luminary 11. Furthermore, the driver includes a protecting circuit 14 electrically connected between the step-up circuit 13 and the luminary 11. Meanwhile, the driving circuit can be a step-up circuit via capacitor-inductor oscillating. The preferred embodiment of the present invention of the luminary 11 is composed of a laser diode and a photo diode.

Figure 3:
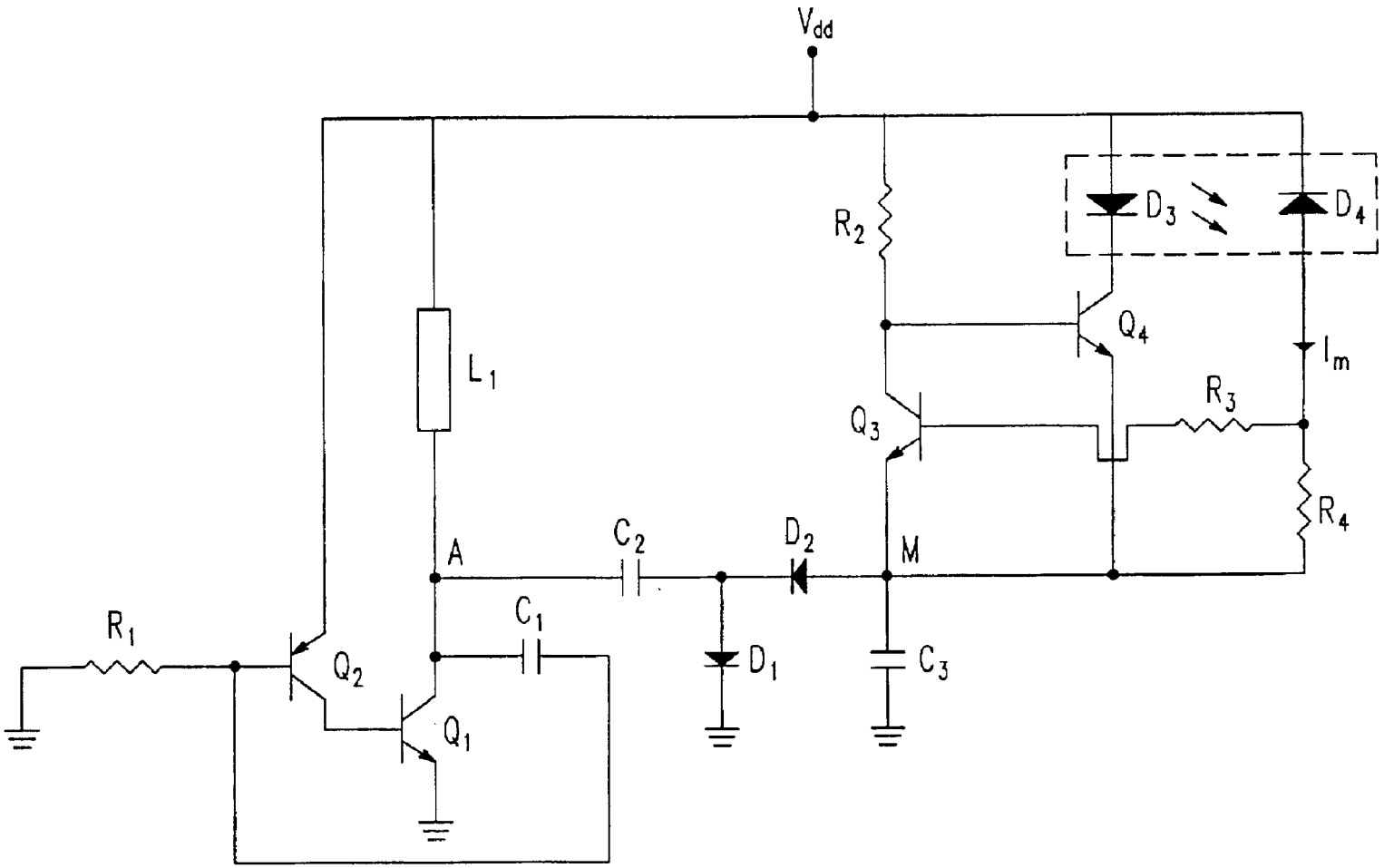
FIG. 3 illustrates a first preferred embodiment of the driver for amplifying an operating voltage of a low driving voltage according to the present invention.

Please referring to FIG. 3, it illustrates a first preferred embodiment of the driver for amplifying an operating voltage of a low driving voltage according to the present invention. In the preferred embodiment, the driving circuit is composed of a first transistor Q1-NPN and a second transistor Q2-PNP. Meanwhile, the collector of the second transistor Q2-PNP is electrically connected to the base of the first transistor Q1-NPN, the collector of the first transistor Q1-NPN is electrically connected to the base of the second transistor Q2-PNP via a first capacitor C1, a grounded resistor for biasing voltage is electrically connected the connecting point of the base of the second transistor Q2-PNP and the first capacitor C1, the emitter of the second transistor Q2-PNP is electrically connected to a source Vdd, and the emitter of the first transistor Q1-NPN is grounded. Furthermore, the driving circuit includes a first inductor L1 having one terminal electrically connected to the source Vdd and another terminal electrically connected to the collector of the first transistor Q1-NPN. Meanwhile, the operating voltage of the first inductor L1 can be relatively low due to an effect of the self-agitated oscillation. The connecting point A of the collector of the first transistor Q1-NPN and the first inductor L1 has an amplified voltage and is electrically connected to a negative multiple voltage circuit. The negative multiple voltage circuit includes a second capacitor C2 electrically connected to the driving circuit a first diode D1 having an anode electrically connected to the second capacitor C2 and a cathode grounded, a second diode D2 having an anode and a cathode electrically connected to the second capacitor C2 and the anode of the first diode D1 simultaneously, and a third capacitor C3 having one terminal electrically connected to the anode of the second diode D2 and the luminary simultaneously and another terminal grounded. Meanwhile the negative multiple voltage circuit can transform and amplify an alternating current signal sent from the driving circuit into a direct current signal. Thus the connecting point M of the anode of the second diode D2 and the third capacitor C3 has a negative amplified voltage, wherein the absolute voltage of the connecting point M is larger than that of the connecting point A.

Finally, the negative amplified voltage can drive the luminary having a protecting circuit and electrically connected to the connecting point M. Meanwhile the protecting circuit includes a third transistor Q3-NPN and a fourth transistor Q4-NPN. The emitter of the third transistor Q3-NPN is electrically connected to the connecting point M of the anode of the second diode D2 and the third capacitor C3, the collector of the third transistor Q3-NPN is electrically connected to the base of the fourth transistor Q4-NPN, the base of the third transistor Q3-NPN is electrically connected to a photo diode D4 via a resistor R3, the emitter of the fourth transistor Q4-NPN is electrically connected with a resistor R4 and the connecting point M, and the collector of the fourth transistor Q4-NPN is electrically connected to a laser diode D3. The operating principle of the protecting circuit is described as the following.

When the emitter of the third transistor Q3-NPN electrically connected to the connecting point M receives the negative amplified voltage, and then provide an outputting current to the base of the fourth transistor Q4-NPN, thereby the inputting current of the collector of the fourth transistor Q4-NPN increasing and the laser diode D3 triggering the photo diode D4 continuously. When the laser diode D3 triggers the photo diode D4 continuously, the monitoring current Im is increased simultaneously, so as to conduct the third transistor Q3-NPN. On the contrary, the outputting and the inputting current of the collector and the base of the fourth transistor Q4-NPN reduces respectively , thereby the laser diode D3 reducing the triggering current of the photo diode D4 and the laser light outputting stably.

Figure 4:
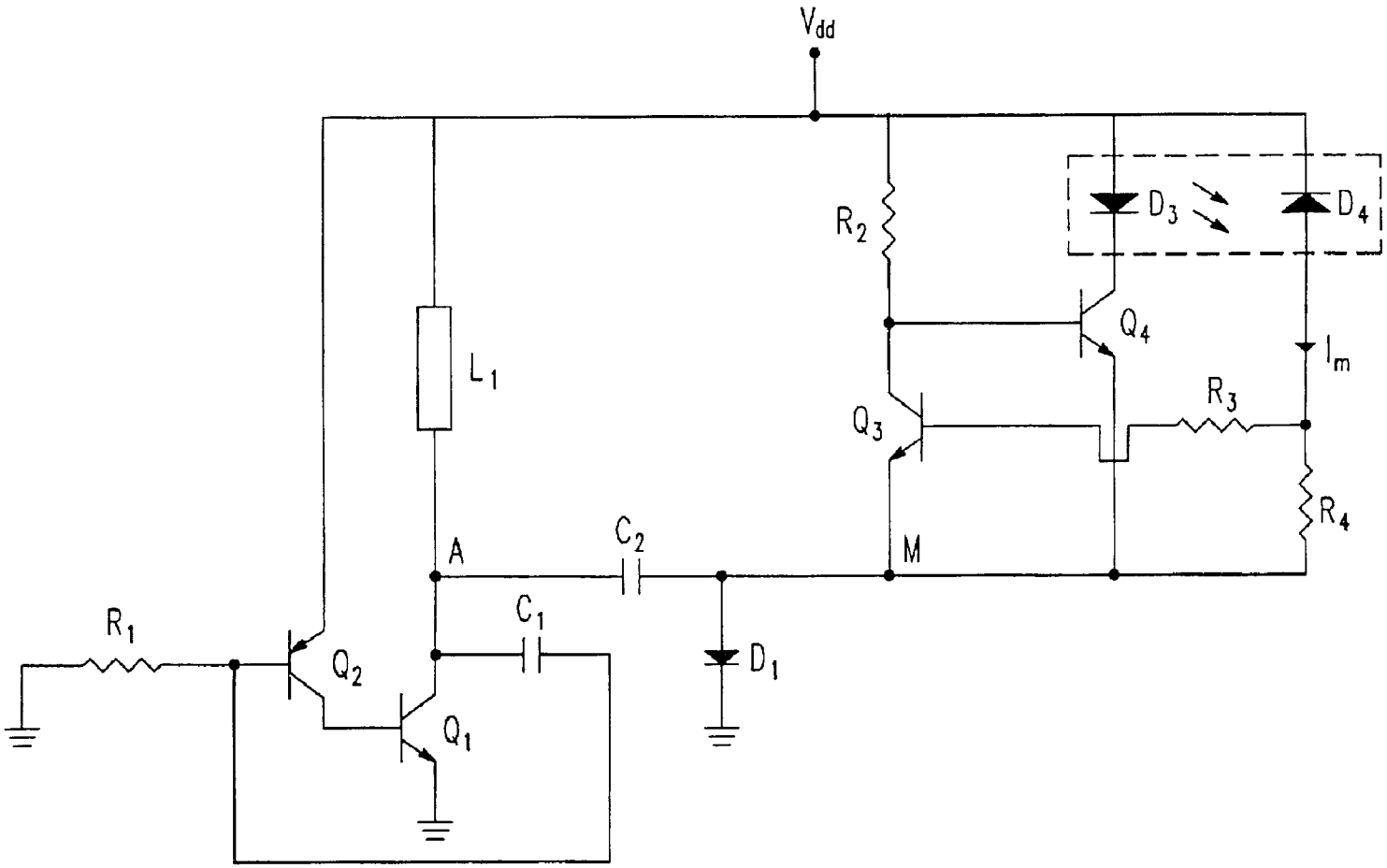
FIG. 4 illustrates a second preferred embodiment of the driver for amplifying an operating voltage of a low driving voltage according to the present invention.

Please referring to FIG. 4, it illustrates a second preferred embodiment of the driver for amplifying an operating voltage of a low driving voltage according to the present invention. Comparing FIG. 4 with FIG. 3, the driver omits the second diode D2 and the third capacitor C3. In the fact, the operating principle of the second embodiment according to FIG. 4 is the same as that of FIG. 3, and the second embodiment also can achieve the effect as the first embodiment does. Accordingly, the driver of the present invention is variable. Even if any equivalent element is omitted or added, the effect of the driver according to the present invention can't be influenced and the present invention is patentable.

Figure 5:
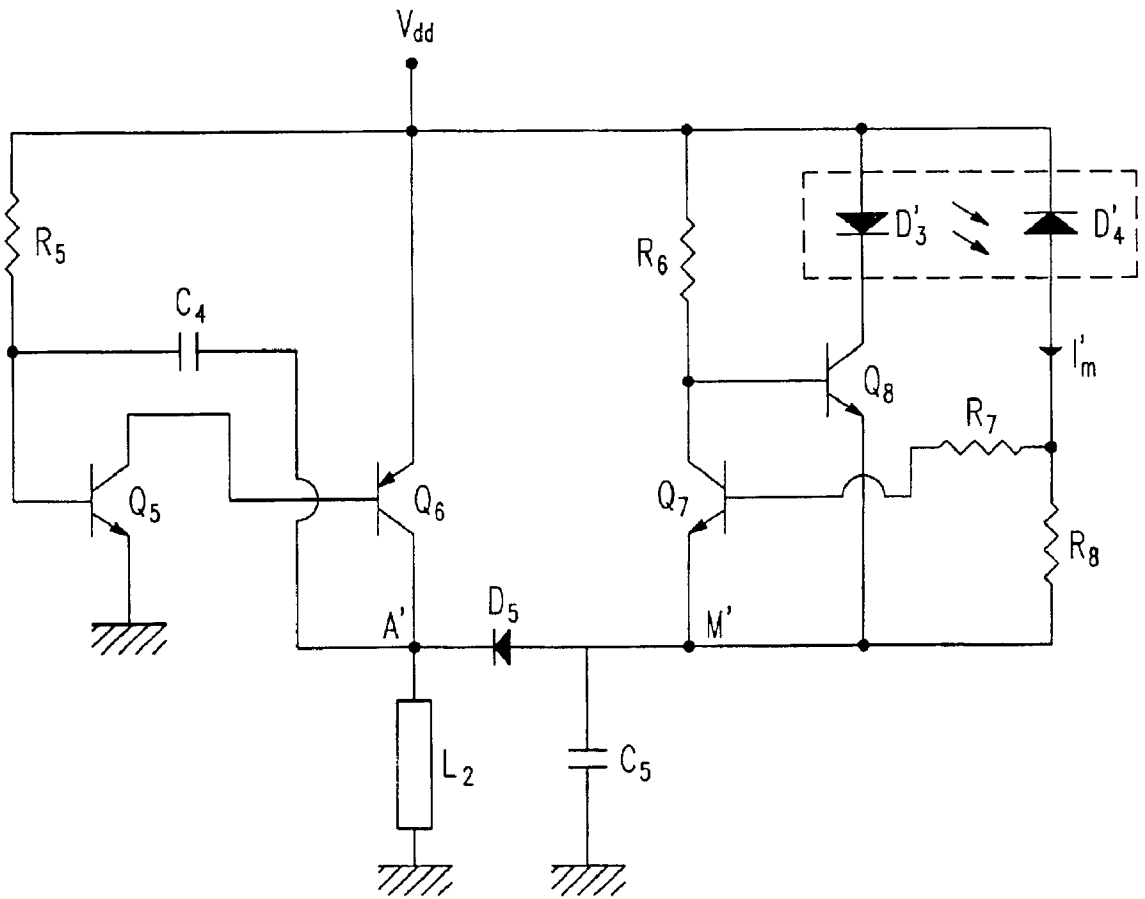
FIG. 5 illustrates a third preferred embodiment of the driver for amplifying an operating voltage of a low driving voltage according to the present invention.

Please referring to FIG. 5, it illustrates a third preferred embodiment of the driver for amplifying an operating voltage of a low driving voltage according to the present invention. In the preferred embodiment, the driving circuit is composed of a fifth transistor Q5-NPN and a sixth transistor Q6-PNP. Meanwhile, the collector of the fifth transistor Q5-NPN is electrically connected to the base of the sixth transistor Q6-PNP, the base of the fifth transistor Q5-NPN is electrically connected to the collector of the sixth transistor Q6-PNP via a fourth capacitor C4, a fifth resistor R5 is electrically connected the connecting point of the base of the fifth transistor Q5-NPN and the fourth capacitor C4, the emitter of the sixth transistor Q6-PNP is electrically connected to a source Vdd, and the emitter of the fifth transistor Q5-NPN is grounded. Furthermore, the driving circuit includes a second inductor L2 having one terminal grounded and another terminal electrically connected to the collector of the sixth transistor Q6-PNP. Meanwhile, the operating voltage of the second inductor L2 can be relatively low due to an effect of the self-agitated oscillation. The connecting point A' of the collector of the sixth transistor Q6-PNP and the second inductor L2 has an amplified voltage and is electrically connected to a rectifying circuit. The rectifying circuit includes a fifth diode D5 and a fifth capacitor C5. The fifth diode has a cathode electrically connected to the connecting point A' and an anode electrically connected to the fifth capacitor C5. The fifth capacitor C5 has one terminal electrically connected to the anode of the fifth diode D5 and the luminary simultaneously and another terminal grounded. Meanwhile the rectifying circuit can transform and amplify an alternating current signal sent from the driving circuit into a direct current signal. Thus the connecting point M' of the anode of the fifth diode D5 and the fifth capacitor C5 has a negative amplified voltage.

Finally, the negative amplified voltage can drive the luminary having a protecting circuit and electrically connected to the connecting point M'. Meanwhile the protecting circuit includes a seventh transistor Q7-NPN and a eighth transistor Q8-NPN. The emitter of the seventh transistor Q7-NPN is electrically connected to the connecting point M' of the anode of the fifth diode D5 and the fifth capacitor C5, the collector of the seventh transistor Q7-NPN is electrically connected to the base of the eighth transistor Q8-NPN, the base of the seventh transistor Q7-NPN is electrically connected to a photo diode D4' via a resistor R7, the emitter of the eighth transistor Q8-NPN is electrically connected with a resistor R8 and the connecting point M', and the collector of the eighth transistor Q8-NPN is electrically connected to a laser diode D3'. The operating principle of the protecting circuit is described as the following.

When the emitter of the seventh transistor Q7-NPN electrically connected to the connecting point M' receives the negative amplified voltage, and then provide an inputting current to the base of the eighth transistor Q8-NPN, thereby the outputting current and the inputting current of the collector and the base of the eighth transistor Q8-NPN increasing respectively and the laser diode D3' triggering the photo diode D4' continuously. When the laser diode D3' triggers the photo diode D4' continuously, the monitoring current Im' is increased simultaneously, so as to conduct the seventh transistor Q7-NPN. On the contrary, the outputting current of the collector of the eighth transistor Q8-NPN reduces, thereby the laser diode D3' reducing the triggering current of the photo diode D4' and the laser light outputting stably.

Accordingly, the present invention provides a step-up circuit electrically connected between a driving circuit and a protecting circuit, thereby the operating voltage being amplified for triggering the luminary continuously, so as to output a light stably.

Although the present invention has been described and illustrated in detail, it is to be clearly understood that the same is by the way of illustration and example only and is not to be taken by way of limitation, the spirit and scope of the present invention being limited only by the terms of the appended claims.

What is claimed is:

1. A driver for amplifying an operating voltage of a luminary, comprising:

a driving circuit providing a first signal; and a negative multiple voltage circuit electrically connected to said driving circuit and said luminary respectively for transforming said first signal into a second signal to be transmitted to said luminary, thereby said luminary being driven in response to said second signal;

wherein said negative multiple voltage circuit further comprises:

a first capacitor electrically connected to said driving circuit;

a first diode having an anode electrically connected to said first capacitor and a cathode grounded;

a second diode having an anode and a cathode electrically connected to said first capacitor and said anode of said first diode simultaneously; and a second capacitor having one terminal electrically connected to said anode of said second diode and said luminary simultaneously and another terminal grounded.

2. The driver according to claim 1, wherein said first signal is an alternating current signal.

3. The driver according to claim 1, wherein said second signal is a direct current signal.

4. The driver according to claim 1, wherein said second signal is a negative voltage.

5. The driver according to claim 1, wherein said second signal has an absolute voltage larger than that of said first signal.

6. The driver according to claim 1, wherein said operating voltage is larger than 4.5 V.

7. The driver according to claim 1, wherein said luminary is driven via a relatively low driving voltage.

8. The driver according to claim 7, wherein said relatively low driving voltage is ranged from 0 to 1.5 V.

9. The driver according to claim 1, wherein said driving circuit is a step-up circuit via capacitor-inductor oscillating.

10. The driver according to claim 6 further comprising a protecting circuit electrically connected between said anode of said second diode and said luminary.

11. A driver for amplifying an operating voltage of a luminary and driving said luminary, comprising:

a driving circuit providing a first signal; and a rectifying circuit electrically connected to said driving circuit and said luminary respectively for transforming said first signal into a second signal to be transmitted to said luminary, thereby said luminary being driven in response to said second signal;

wherein said rectifying circuit further comprises:

a diode having a cathode electrically connected to said driving circuit and an anode; and a capacitor having one terminal electrically connected to said anode of said diode and said luminary simultaneously and another terminal grounded.

12. The driver according to claim 11, wherein said first signal is an alternating current signal.

13. The driver according to claim 11, wherein said second signal is a direct current signal.

14. The driver according to claim 11, wherein said second signal is a negative voltage.

15. The driver according to claim 11, wherein said second signal has an absolute voltage larger than that of said first signal.

16. The driver according to claim 11, wherein said operating voltage is larger than 4.5 V.

17. The driver according to claim 11, wherein said luminary is driven via a relatively low driving voltage.

18. The driver according to claim 17, wherein said relatively low driving voltage is ranged from 0 to 1.5 V.

19. The driver according to claim 11, wherein said driving circuit is a step-up circuit via capacitor-inductor oscillating.

20. The driver according to claim 11, further comprising a protecting circuit electrically connected between said anode of said diode and said luminary.

21. A driver for amplifying an operating voltage of a luminary and driving said luminary, comprising:

a driving circuit providing a first signal; and a step-up circuit electrically connected to said driving circuit and said luminary respectively for transforming said first signal into a second signal to be transmitted to said luminary, thereby said luminary being driven in response to said second signal;

wherein said step-up circuit further comprises:

a first capacitor electrically connected to said driving circuit;

a first diode having an anode electrically connected to said first capacitor and an cathode grounded;

a second diode having an anode, and a cathode electrically connected to said first capacitor and said anode of said first diode simultaneously; and a second capacitor having one terminal electrically connected to said anode of said second diode and said luminary simultaneously and another terminal grounded.

22. The driver according to claim 21, wherein said first signal is an alternating current signal.

23. The driver according to claim 21, wherein said second signal is a direct current signal.

24. The driver according to claim 21, wherein said operating voltage is larger than 4.5 V.

25. The driver according to claim 21, wherein said luminary is driven via a relatively low driving voltage.

26. The driver according to claim 25, wherein said relatively low driving voltage is ranged from 0 to 1.5 V.

27. The driver according to claim 21, wherein said driving circuit is a step-up circuit via capacitor-inductor oscillating.

28. The driver according to claim 21, further comprising a protecting circuit electrically connected between said anode of said second diode and said luminary.

29. The driver according to claim 21, wherein said step-up circuit is a negative multiple voltage circuit.

30. The driver according to claim 29, wherein said negative multiple voltage circuit further comprises:

a first capacitor electrically connected to said driving circuit;

a first diode having a cathode electrically connected to said first capacitor and an anode grounded;

a second diode having an anode, and a cathode electrically connected to said first capacitor and said cathode of said first diode simultaneously; and a second capacitor having one terminal electrically connected to said anode of said second diode and said luminary simultaneously and another terminal grounded.

31. The driver according to claim 30 further comprising a protecting circuit electrically connected between said anode of said second diode and said luminary.

32. The driver according to claim 21, wherein said step-up circuit is a rectifying circuit.

33. The driver according to claim 32, wherein said rectifying circuit further comprises:

a diode having a cathode electrically connected to said driving circuit and an anode;

a capacitor having one terminal electrically connected to said anode of said diode and said luminary simultaneously and another terminal grounded.

34. The driver according to claim 33 further comprising a protecting circuit electrically connected between said anode of said diode and said luminary.

* * * * *